US005172752A

United States Patent [19]

Goetz, Jr.

[11] Patent Number: 5,172,752

[45] Date of Patent: Dec. 22, 1992

[54] CURVED HEAT EXCHANGER WITH LOW FRONTAL AREA TUBE PASSES

[76] Inventor: Edward E. Goetz, Jr., 27935 Quail Hollow Ct., Farmington Hills, Mich. 48331

[21] Appl. No.: 775,011

[22] Filed: Oct. 11, 1991

Related U.S. Application Data

[63] Continuation-in-part of Ser. No. 537,497, Jun. 12, 1990, Pat. No. 5,078,026.

[51] Int. Cl.[5] ..... F28D 1/04; F28F 13/12; F28F 9/26; F01P 7/10

[52] U.S. Cl. ..... 165/41; 165/51; 165/150; 165/125; 165/153; 165/135; 165/140; 123/41.49

[58] Field of Search ..... 165/125, 41, 51, 125, 165/135, 140, 150, 153; 123/41.49

[56] References Cited

U.S. PATENT DOCUMENTS

| | | | |
|---|---|---|---|
| 1,365,759 | 1/1921 | Witte | 165/153 |
| 2,029,891 | 2/1936 | Newman . | |
| 2,429,508 | 10/1947 | Belaieff | 165/125 |
| 2,646,027 | 7/1953 | Akerman et al. . | |
| 2,650,073 | 8/1953 | Holm | 165/152 |
| 2,792,200 | 5/1957 | Huggins et al. | 165/125 |
| 4,062,401 | 12/1977 | Rudny et al. | 165/125 |
| 4,202,296 | 5/1980 | Nonnenmann et al. . | |
| 4,373,577 | 2/1983 | McMillen | 165/148 |
| 4,434,841 | 3/1984 | Jackson et al. . | |
| 4,510,991 | 4/1985 | Kawahira . | |
| 4,909,311 | 3/1990 | Nakamura et al. | 165/41 |
| 5,078,206 | 1/1992 | Goetz, Jr. | 165/125 |

FOREIGN PATENT DOCUMENTS

| | | | |
|---|---|---|---|
| 0036213 | 9/1981 | European Pat. Off. | 165/125 |
| 0193088 | 11/1983 | Japan | 165/125 |
| 582245 | 11/1946 | United Kingdom | 165/152 |

*Primary Examiner*—John K. Ford
*Attorney, Agent, or Firm*—Joseph W. Farley

[57] ABSTRACT

A curved heat exchanger for a vehicle has tubes generally sector shaped in cross section and arranged in an arcuate pattern to transmit heat exchanger fluid between laterally spaced tanks. One embodiment has discrete heat exchanger fluid sections respectively connected to a vehicle engine, torque converter transmission and between the air conditioner compressor and evaporator. The tubes are tilted to align air passages therebetween with the radial direction of air flow discharged from an interior fan so that there is improved fan-heat exchanger matching resulting in reduced separation of air from the surfaces of the heat exchanger tubes and turbulence in the air passages. The side walls of adjacent tubes are equally spaced from one another to receive standard width air centers therebetween. The tubes may have discrete inner and outer flow sections insulated from one another and respectively employed to conduct engine coolant and another heat exchanger fluid such as for the air conditioning system. This invention features air pressure drop through the core so that a low horse power motor drive can be effectively utilized to pump cooling air through the heat exchanger. In another embodiment of the invention, axial flow fans are mounted at the ends of the cylindrical heat exchanger.

13 Claims, 5 Drawing Sheets

CURVED HEAT EXCHANGER WITH LOW FRONTAL AREA TUBE PASSES

This application is a continuation-in-part of my copending application U.S. Ser. No. 537,497 filed Jun. 2, 1990now U.S. Pat. No. 5,078,206 entitled TUBE AND FIN CIRCULAR HEAT EXCHANGER. This application incorporates heat exchanger constructions of my disclosure document No. 278843 entitled HEAT EXCHANGER AND HEAT EXCHANGER TUBING, filed in the U.S. Patent and Trademark Office on Apr. 10, 1991.

FIELD OF THE INVENTION

This invention relates to heat exchangers, and more particularly to a heat exchanger having tubes arranged in a curved pattern with sector shaped cross sections presenting low frontal areas and providing pressure drop for improved flow of cooling air directed by an associated fan through the air centers between the tubes to improve heat exchanger and fan performance.

DESCRIPTION OF THE RELATED ART

U.S. Pat. No. 4,909,311, issued Mar. 20, 1990, discloses a cylindrical shaped heat exchanger mounted in a forward compartment of a vehicle with axial discharge fans at opposite ends of the radiator for exhausting air drawn through the core of the heat exchanger.

U.S. Pat. No. 4,062,401, issued Dec. 13, 1977, discloses a toroidal like and segmented heat exchanger for a vehicle with discrete sections for cooling engine and transmission fluids, as well as a third section for cooling other hydraulic fluids.

U.S. Pat. No. 2,650,073, issued Aug. 25, 1953, discloses a heat exchanger having concentric tubes with segments to divide each tube into discrete flow conducting passages.

Japan Patent, document 0193088, discloses a cylindrical heat exchanger having inclined rows of heat exchanger fluid flow tubes therein extending through flattened plate type fins through which air is pumped by an internal blower.

SUMMARY OF THE INVENTION

This invention is drawn to heat exchangers and to new and improved heat exchanger tubes, to the arcuate arrangement of such tubes relative to a fan or blower, and to the employment of such tubes and tube arrangements to provide a plurality of discrete heat exchangers in a unitized package.

The present invention provides a new and improved heat exchanger with tubes of sector shaped cross section arranged in a circular pattern with the ends thereof in operative communication with flow tanks, and having heat-dissipating air centers formed from corrugated rectilinear stock of substantially uniform widths for uniform spaced line contact with adjacent sides of the tubes.

In some preferred arrangements, the tubes are tilted or inclined with respect to radial planes so that the air flow passages between adjacent tubes have improved alignment with respect to the resultant velocity path of the air stream pumped from the center of the heat exchanger core outward by an internal blower or fan so that resistance and turbulence is advantageously reduced.

In another embodiment, axial flow discharge fans are located at the ends of the heat exchanger core so that air is drawn from the exterior of the core through the air centers to the center thereof, and then outwardly through the ends of the core. With interior air centers larger in width than the outer air centers, the core acts as a diffuser with advantageous air pressure drop through the core reducing the horsepower requirements of the fan.

The present invention also provides new and improved tubes for a heat exchanger, each having a sector shaped cross section so that when tubes are arcuately spaced the side walls of adjacent tubes are substantially parallel and provide substantially equal and constant spaces therebetween. With this construction standardized, air center construction generally rectilinear in plan view can be employed therewith in a curved heat exchanger design. The cross section of the tubes is preferably enlarged to increase flow capacity, and thereby reduce fluid velocity to increase transit time for increased heat transfer to the cross flow of ambient air passing through the air centers.

The present invention additionally can be employed as an engine cooling radiator arrangement for automobiles, which can be used with a transverse engine and with an engine driven fan internal of the radiator for optimized streamlining of the vehicle with low hood lines and preferably with air intake beneath the vehicle such as below the front bumper.

It is a further feature, object and advantage of this invention to provide a new and improved heat exchanger with discrete and independent sections to function with plural heat handling mechanisms.

Another feature, object and advantage of this invention is to provide a new and improved heat exchanger and fan match with tailored alignment of the air passages in the heat exchanger core with the discharge flow of an associated fan.

These and other features, objects and advantages of the present invention will become more apparent from the following detailed description and drawings in which:

DESCRIPTION OF THE PREFERRED EMBODIMENTS

Figure 1:
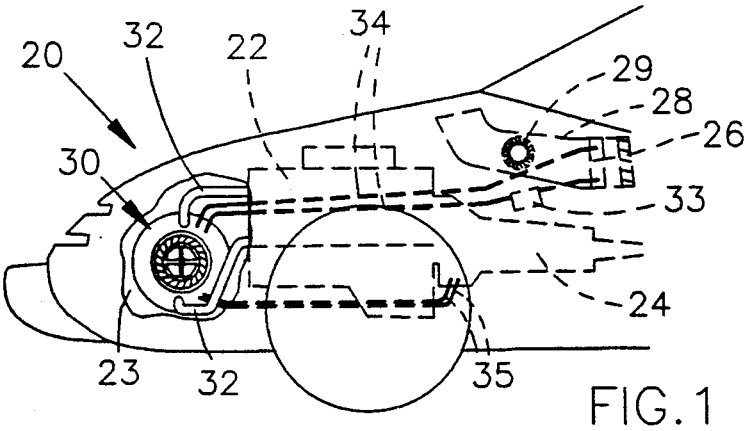
FIG. 1 is a side elevation view of a portion of a motor vehicle having an internal combustion engine, power transmission, air conditioning system and an associated heat exchanging unit therefor.

Turning now in greater detail to the drawings, there is shown in FIG. 1 a portion of an automotive vehicle 20 having a liquid cooled internal combustion engine 22 operatively mounted within an accessible front compartment 23 of the vehicle. The engine is adapted to drive a hydrodynamic torque converter and automatic change speed transmission 24 that powers the driving road wheels of the vehicle through differential gearing, not illustrated.

The vehicle may have an air conditioning system that includes an evaporator 26 located in a modular housing 28 located within the front compartment. Conventional blower 29 is driven to force air through the evaporator to cool the occupant compartment of the vehicle.

The air conditioning system further includes a compressor and an accumulator diagrammatically shown at 33, and a condenser that may be provided by a discrete section of a cylindrical heat exchanger unit 30 operatively mounted within the front compartment forward of the, engine 22. The heat exchanger unit may have various configurations which are described in some detail below.

The engine 22 has a conventional coolant system operatively connected by hoses, diagrammatically illustrated at 32 in FIG. 1, to an end tank of the cylindrical heat exchanger unit 30 as a whole, or alternatively, to a discrete first section thereof that is completely separate from other sections such as a second section that may, for example, be an air conditioner condenser section connected to the evaporator 21 and compressor 33 by lines 34. The transmission, for example, may also be hydraulically coupled by lines 35 to a third section of the heat exchanger unit, as will be later described.

Figure 2:
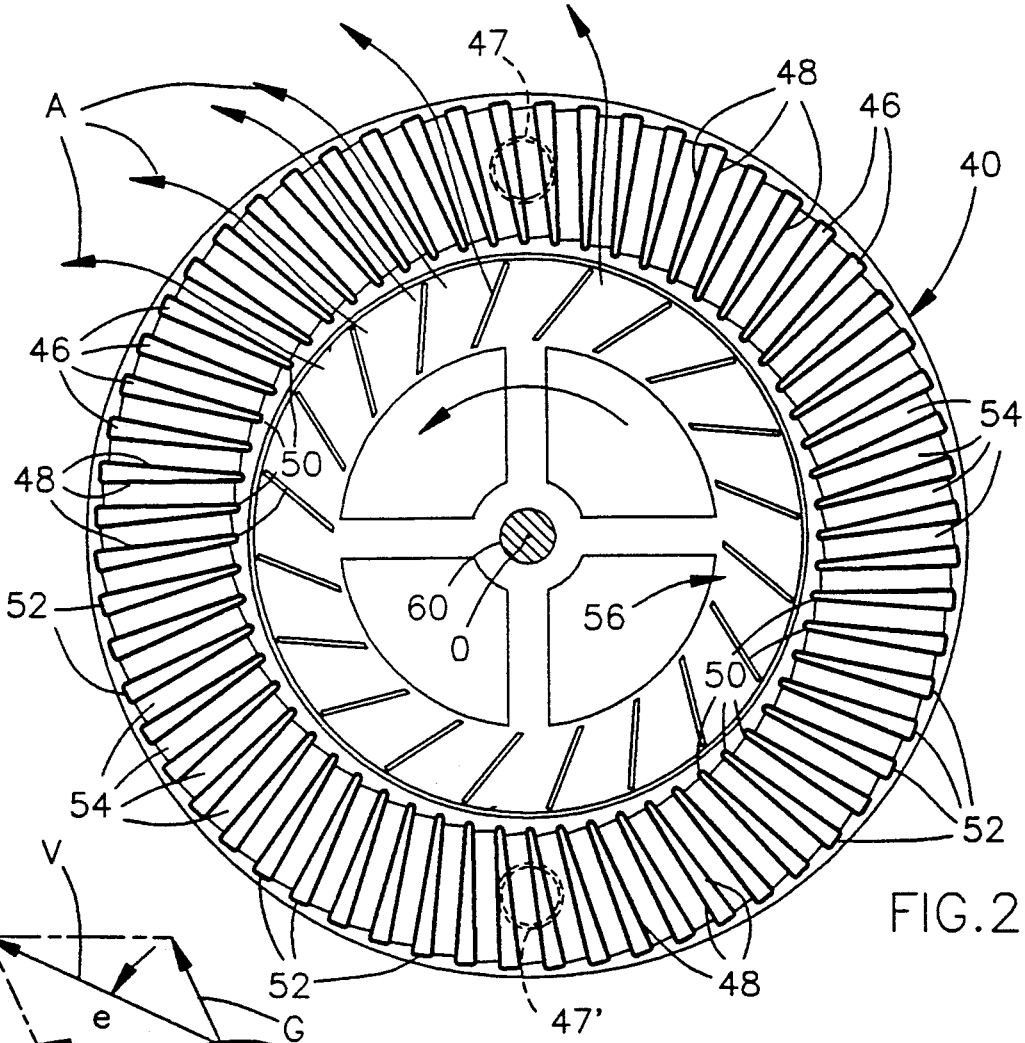
FIG. 2 is a side view partly in cross section of a cylindrical heat exchanger and an associated transverse fan for forcing air outwardly through the core of the heat exchanger illustrating one embodiment of the invention.
Figure 3:
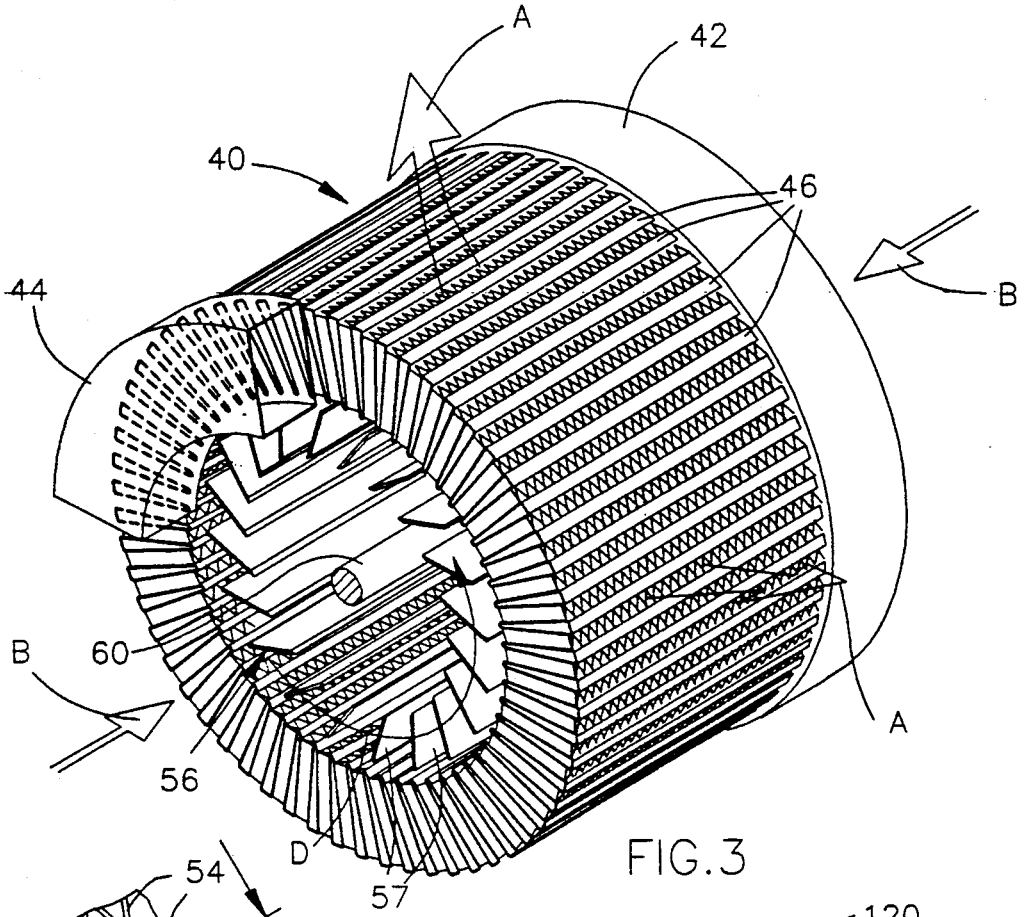
FIG. 3 is a pictorial view with parts broken away of a portion of the heat exchanger and fan unit of FIG. 2.

While as stated above, the heat exchanger of this invention can effectively service different discrete heat producing units, such as the internal combustion engine 22 and the transmission 24, and also provide the condenser section of the air conditioning system, it may be employed primarily as a radiator for the internal combustion engine. Such a construction is illustrated in FIGS. 2 and 3 in the form of a cylindrical core 40 and a pair of toroidal and laterally-spaced end tanks 42 and 44 hydraulically interconnected to one another by elongated tubes 46, which conduct heat exchanger fluid from one end tank to the other. The tanks 42 and 44 are suitably baffled, as disclosed in my co-pending application U.S. Ser. No. 537,497 referenced above, so that the flow is serpentined through the core provided by the tubes from a tank inlet 47 to a tank outlet 47'.

Each of the tubes 46 is sector shaped in cross section and has side walls 48 which diverge outward from a low profiled and rounded leading nose portion 50 to an outer peripheral back wall 52. With this construction, a streamlined tubes is provided so that air flow, flow arrows A, from the rounded nose portion outward flows smoothly and will tend to be laminar or at least have reduced boundary layer separation and reduced resultant turbulence. The tubes 46 are spaced from one another so that the diverging sides 48 of each tube are substantially parallel with the side wall of the next adjacent tube, as illustrated in FIG. 2.

Figure 3A:
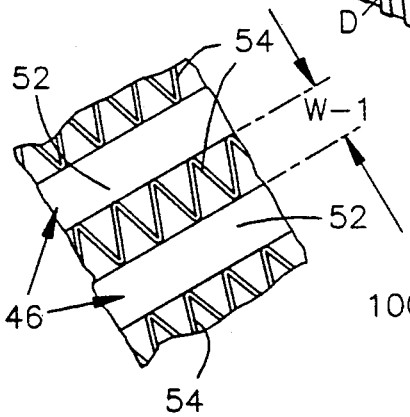
FIG. 3*a* is an enlarged view of a portion of FIG. 3 to illustrate constant width air centers between adjacent tube passes.
Figure 5:
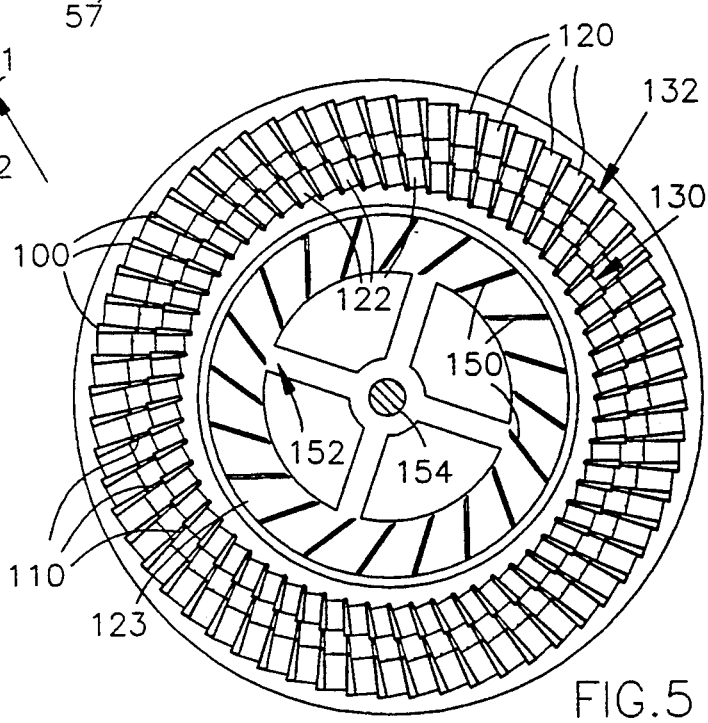
FIG. 5 is a sectional view of one end of the core of the heat exchanger and fan unit of FIG. 4.

With this tube configuration and arcuate arrangement thereof, the interfacing sides 48 are equidistant from one another so that standardized, commercially available corrugated air centers 54 of substantially constant widths, width W-1 in FIG. 3A, can be operatively installed between the tubes to increase their heat exchanging efficiency and to increase the burst strength of the heat exchanger unit. These corrugated air centers importantly conduct heat energy from the coolant flowing through the tube passes and their large surface areas provide advanced cooling capacity as compared to disk or plate type cooling fins.

Cooling air is forced through the air centers of the heat exchanger by a powered fan which may be of any suitable construction, such as the transverse centrifugal fan 56 best illustrated in FIGS. 2, 3, 4 and 5. When rotatably driven, the fan with rearwardly inclined fan blades 57 pumps intake air fed from opposite ends of the radiator core 40, flow arrows B in FIG. 3, and then in a general radial direction outward through the air centers and past the sides of each of the tubes to the exterior of the unit, as illustrated by flow arrows A. This air carries heat energy from the engine heated coolant circulating through the tubes 46 between the tank 42 and tank 44, which is in turn operatively connected by the coolant transmitting hoses 32 to the coolant jacket of the internal combustion engine.

The fan can be driven by any suitable means, such as by power take off from the vehicle engine as shown and described in my above referenced co-pending application, or by an electric motor as is employed in many vehicle applications.

In any event, this invention is compatible to a wide range of fan constructions, and fan drives, since the small radiused forward ends 50 of the tubes present low frontal resistance for air pumped outwardly from the interior to the exterior of the cylindrical heat exchanger. Also, the exiting flow from the fan is substantially aligned with the air passages provided between the tubes, and since there is no restriction other than the minimal restriction of the air centers, the fan 56 can pump air through the core with high efficiency and minimized horsepower requirements.

Figure 2A:
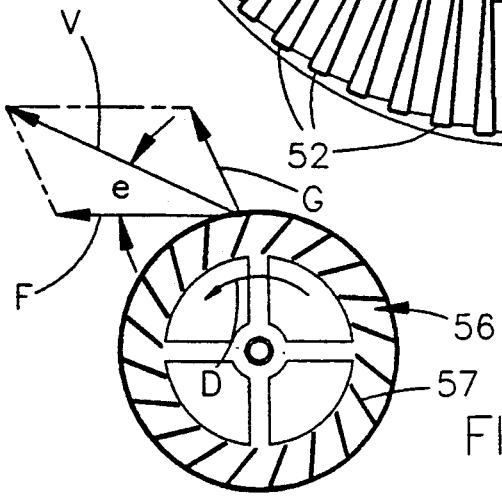
FIG. 2*a* is a diagram illustrating velocity air flow vectors at exit from a transverse type fan such as shown in FIG. 2.

In viewing FIGS. 2, 2*a* and 3, it will be understood that when the transverse fan 56 is driven in a counterclockwise direction "D" at a predetermined RPM, the pumped air has a resultant velocity "V" which enters the core at angle "e", which is the angle between the peripheral velocity vector "F" and the radial component of the exit velocity "G". The air at resultant velocity "V" being the vector sum of the peripheral velocity "F", and the radial component of the exit velocity "G", enters the air flow paths formed between adjacent tubes 46.

This invention importantly has improved alignment or matching of the angle of the cooling air flow paths with the exit angle of air pumped by the fan. As best shown in FIGS. 2 and 2*a*, the blades 57 of the transverse fan 56 are inclined or curved in a rearward direction so that the resultant velocity "V" of the discharged air is aligned with the air flow passages provided between adjacent tubes, and accordingly, enters at an advantageous angle into the core of the heat exchanger. More particularly, with the resultant velocity having a predetermined exit angle, the tubes 46 are correspondingly inclined or tilted along their major axes at the same angle, 12° for example, relative to radial lines through the core originating at the center 0 of fan drive shaft 60 so that the flow channels provided by the air centers are optimally aligned with the direction of air pumped by the fan.

With the streamlined envelope of each of the tubes, and with the air entering the air centers between the tubes at an angle which approximates the tilt angle of the tubes, the boundary air flow through the air centers past the tubes is primarily laminar and turbulence is substantially reduced. Furthermore, since resistance or back pressure is eliminated or reduced, there is an advantageous pressure drop. The fan-heat exchanger construction of this invention accordingly provides for optimized matching of these components with the fan pumping air through the core of the radiator with minimized horsepower requirement.

Since the present invention provides for improved flow of air past the tubes, the fan can be driven with a low horsepower motor or by employing a drive from the engine which requires minimized input from the engine. Resultantly, this provides more engine power to drive the vehicle and other components, such as the air conditioner compressor and pumps for the engine coolant and power steering.

The embodiments of the invention illustrated by FIGS. 4 through 8, are generally similar to that of FIGS. 2 and 3 but features important changes in the tubes and the core and tank construction. In this construction, each of the tubes 100 of the heat exchanger core 102 that extend between header plates 103 and 104, are divided throughout their lengths to provide discrete inner and outer sections 106 and 107 providing separate flow passages 108 and 109 therethrough. These sections and their flow passages are separated and effectively heat insulated by a web portion 110. The side walls of the web portion are continuation of the side walls of the outer section 107 until connected with the outer wall 116 of the inner section 106. As shown, the web portion 110 is trapezoidal in cross section having an outer wall 112 defining the lower limit of passage 109 of the outer section 107 and having an inner wall which is formed by a central portion of the outer wall 116 of the inner section 106.

In this embodiment, the outer sections 107 of the tubes 100 are used for the engine cooling radiator fluid while the inner sections 106 are employed for the cooling of other components of the vehicle, such as the transmission oil and as condenser tubes for the air conditioning refrigerant. These tubes 100 are employed with separate and concentric arrangements of corrugated air centers 120 and 122. The outer sections 107 are larger in width than the inner sections 106. The air centers 120 between the outer sections 107 have substantially equal widths and are slightly wider than the air centers 122 between the inner sections 106 so that there is a progressively increasing opening for the cooling air pumped by the transverse fan 123 operatively mounted in the center of the core 102 to provide a large pressure drop across the core so that the horsepower requirements of the fan drive will be minimized.

Figure 6:
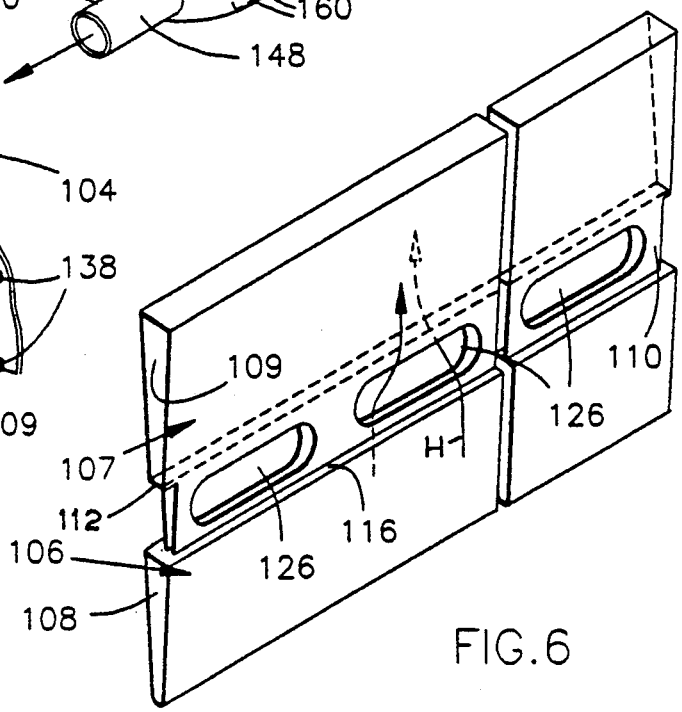
FIG. 6 is a pictorial view of one of the tubular passes of the heat exchanger of FIGS. 4 and 5.

The web portion 110 between the sections can be provided with the openings 126, shown in FIG. 6, so that air can flow from one side of each tube to the other, as shown by air flow arrows H to provide improved heat isolation of outer flow section 107 of the tube 100 with respect to the inner section 106. The tubes, such as shown in FIG. 6, can be extruded and the holes 126 punched subsequently therein.

In this embodiment of the invention, the cylindrical heat exchanger core has concentric inner and outer heat exchanger rings 130 and 132 which are hydraulically isolated from one another to service different components of the vehicle.

Figure 4:
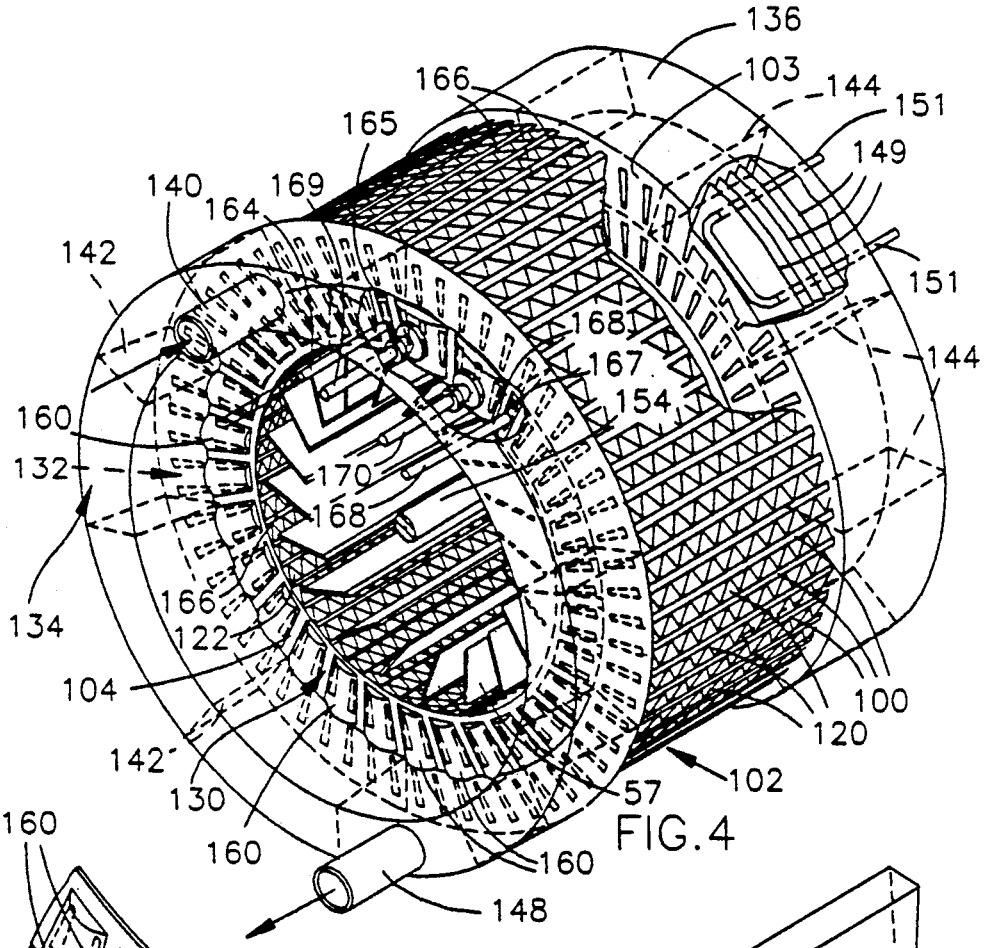
FIG. 4 is a pictorial view of a cylindrical heat exchanger having separate heat dissipating sections illustrating a second embodiment of the invention.
Figure 4A:
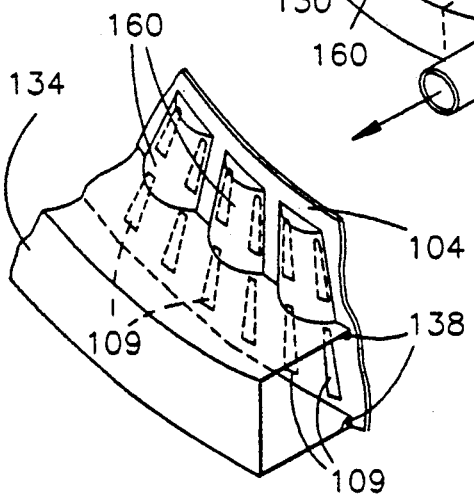
FIG. 4*a* is an enlarged perspective view of a portion of the end of the heat exchanger of FIG. 4.

As best shown in FIG. 4, the outer ring 132 includes the outer section 107 of each tube 100, the header plates 103, 104 through which the opposite ends of the tubes extend and the outer end tanks 134, 136 that are secured to the header plates by brazing or by any suitable means. "O" ring seals, such as seals 138 illustrated in FIG. 4*a*, are employed to prevent leakage of any fluids from the end tanks. Engine coolant is conducted from the engine through a hose, such as shown in FIG. 1, that is secured to an inlet pipe 140 operatively connected into end tank 134. The end tanks 134, 136 are suitably partitioned by partition plates 142, 144 to provide for the serpentine flow through the outer ring of the heat exchanger in clockwise and counterclockwise directions until discharged through discharge pipe 148 that is operatively connected by a hose to the engine for return of the engine coolant, cooled by the outer ring of the heat exchanger.

In addition to cooling engine coolant, the outer ring is capable of cooling other fluids such as that of the power steering system. As shown in FIG. 4, the tank 136 houses a plurality of cooler plates 149 through which oil line 151 of the power steering system extends. These plates are located in a compartment in the tank 136, as defined by adjacent pairs of partition plates 144. Accordingly, as the engine coolant is circulated in the tank, power steering fluid supplied to the compartment by inlet tube has its heat energy transferred to the plates and then to the circulating coolant. As shown, the cooled power steering fluid is returned by the return side line 151.

The transverse fan 123 has a plurality of rearwardly inclined blades 150 operatively mounted by spoked support 152 to a centralized drive shaft 154, which is driven by an electric motor or by a power take-off from the engine to pump cooling air therethrough.

The tubes 100 are also generally of sector shaped cross section and are inclined, 12° for example, with respect to a normal or a radius normally bisecting each tube so that the air passages through the core have improved alignment with the direction of air discharged by the fan. As in the previous embodiments, this alignment provides for improved air flow through the core with pressure drop. Pressure drop is further augmented since the air passages through the core as provided by the air centers and the sides of the tubes progressively increases in area from the interior to the exterior of the core.

The inner ring 130 of the core comprises the inner sections 106 of the tubes, the inner portions of the header plates through which the ends of the tubes extend and arched crossover plates 160, (see FIGS. 4*a* and 6), brazed or otherwise secured, to the header plates to hydraulically interconnect adjacent inner sections of the tubes. These crossover plates eliminate the requirement for a tank construction such as employed on the outer ring, and connecting adjacent tubes for fluids requiring cooling such as the transmission fluid or the air conditioner refrigerant.

Accordingly, a first pipe 164 from the air conditioner compressor is connected to a cover plate 165 of a first tube 166 of the interior ring, and the refrigerant fed thereto circulates in a serpentined manner in a counterclockwise direction until it exits through a terminal tube 167 that is connected by pipe 168 for return to the evaporator, such as evaporator 26 in FIG. 1.

In addition to serving as a condenser section of the air conditioning system, the inner ring can further cool the fluids of the automatic transmission. To this end, the heated oil pumped from the transmission is fed into pipe 169 and is then circulated in a serpentine counterclockwise manner by the inner ring of tubes to a return pipe 170 after being cooled by air flowing past the inner ring portion of the heat exchanger.

Figure 7:
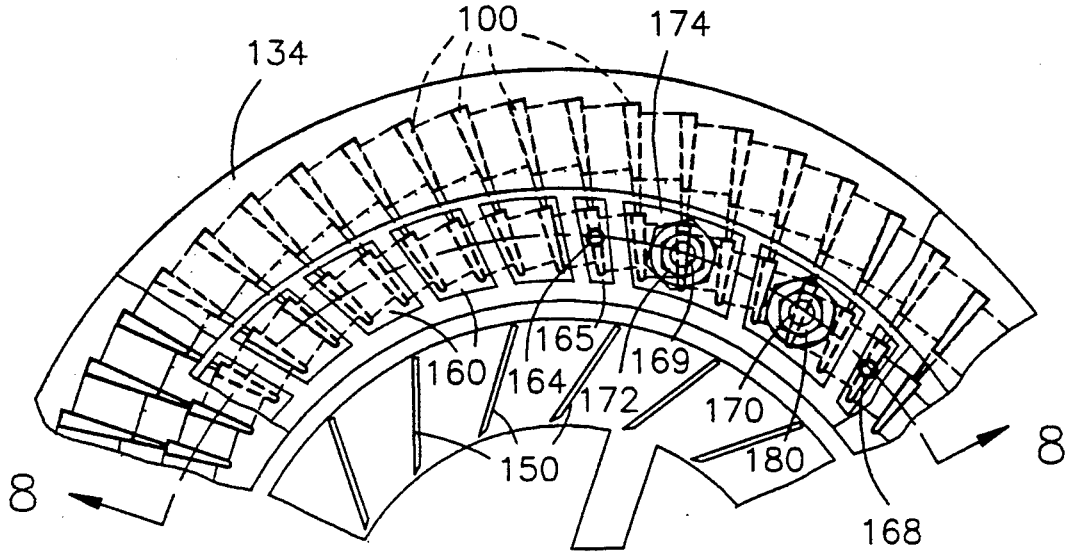
FIG. 7 is an enlarged end view of a portion of a heat exchanger and fan unit similar to the second embodiment of the invention showing a modification thereof.
Figure 8:
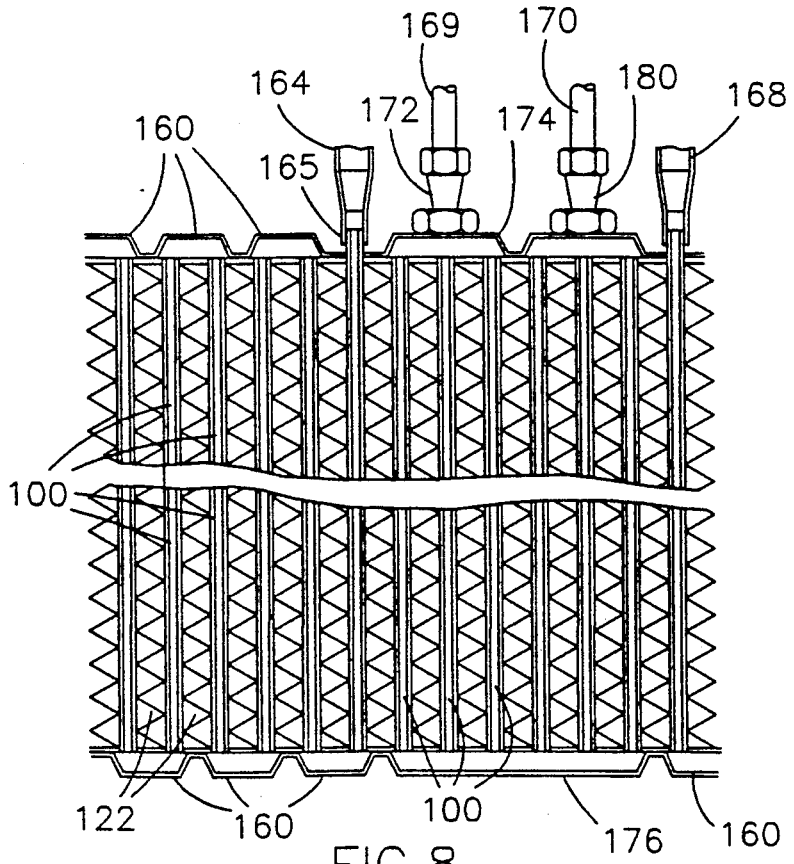
FIG. 8 is a sectional view taken along sight lines 8—8 of FIG. 7.

The construction of FIGS. 7 and 8 is substantially the same as that of FIG. 4 with variation in the crossover plate construction. As shown, the intake pipe 164 from the air conditioner compressor is connected to the inner ring by cover plate 165, Crossover plates 160 brazed to the headers 103 and 104 interconnect the flow passages 108 of the inner sections of the tubes 100. The refrigerant can then circulate from the intake 164 in a serpentine manner through the tubes to the outlet pipe 168 which connects into the evaporator inlet.

In the FIGS. 7 and 8 construction, only a small segment of the inner ring of tubes is used for transmission cooling. To this end, transmission oil inlet pipe 169 is connected to a fitting ;72 of an inlet plate 174 covering the ends of three of the inner flow passages of the tubes 100. A crossover plate 176 at the opposite end of these tubes cover six tubes so that fluid flowing through the first three tubes can crossover to the adjacent three tubes and there pass to an outlet cover plate 178 that is connected by a fitting 180 to a return pipe 170 leading back to the transmission.

Figure 9:
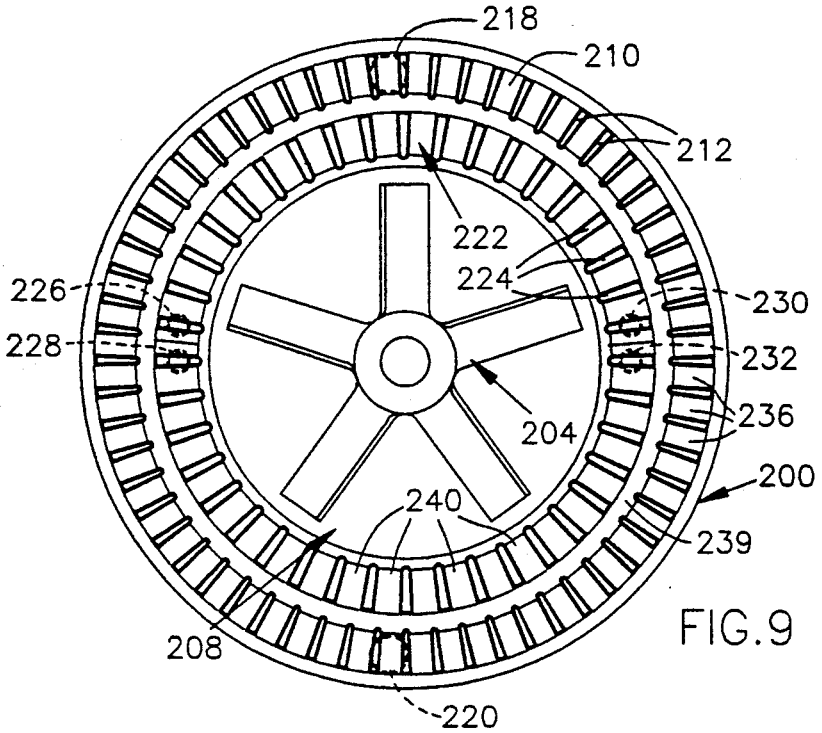
FIG. 9 is a end view, partly in cross section, of a heat exchanger core and associated fan illustrating a further embodiment of the invention.
Figure 10:
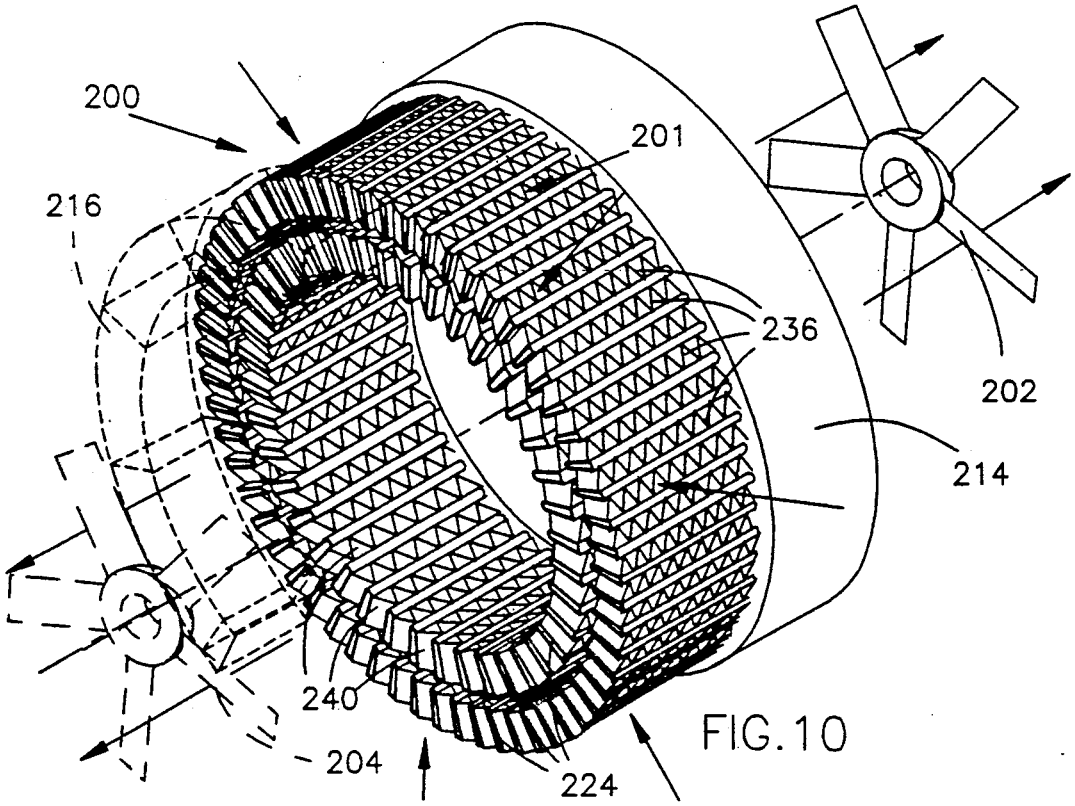
FIG. 10 is a pictorial view of a portion of the heat exchanger core of FIG. 9.

Another embodiment of the invention is shown in FIGS. 9 and 10 in which a heat exchanger 200, having a cylindrical core 201, is arranged with axial flow fans 202 and 204 operatively mounted at the opposite ends thereof, which are rotatably driven to pull air radially inward from the circumference of the core to the central cylindrical opening 208 thereof, and then axially exhaust this air through opposite ends of the heat exchanger.

In this embodiment, the heat exchanger core has an outer ring 210 of arcuately spaced fluid flow conducting tubes 212 that extend through laterally spaced header plates and are operatively connected to laterally spaced end tanks 214 and 216, which are partitioned as in the other embodiments to effect the serpentine flow of fluid through the tubes from the inlet pipe 218 to the outlet pipe 220 that are in turn operatively connected to the cooling system of heat generating equipment, such as an internal combustion engine.

In addition to the outer ring of tubes 210, the heat exchanger further includes in an inner ring 222 of fluid conducting tubes 224 that are entirely separate from the outer ring and are operatively connected to other equipment requiring a heat exchanger to effect the removal of heat energy from fluids circulating therethrough. Inlet and outlet pipes 226, 228 and 230, 232 respectively, illustrate the feed and exhaust of the fluids from the inner ring of the heat exchanger.

Importantly in this embodiment, a drop in air pressure occurs as the cooling air flows from the periphery of the core to the central opening. As shown in FIG. 9, the outer tubes 212 are sector shaped in cross section, and are arcuately spaced from one another so that constant width air centers 236 of corrugated thin wall sheet metal can be employed. With this construction, there is full contact by the apices of the air centers with the side walls of the tubes 212 for improved conduction of heat energy.

The inner ring 222 of tubes is separate and concentric with respect to the outer ring and has arcuately spaced tubes 224 with sector shaped cross sections. The annular space 239 between the concentric rings of tubes provides effective insulation between these separate heat exchangers.

As illustrated, the sides of each of these tubes 224 are also parallel to the sides of the next adjacent tube so that constant width air centers 240 can be employed with the inner ring of tubes. These air centers are somewhat wider than the air centers 236 of the outer ring so that the air passages open as the fans pull air from the exterior of an core to the interior thereof so that the advantageous pressure drop is provided.

While the above description constitutes preferred embodiments of the invention, it will be appreciated that the invention can be modified and varied without departing from the scope of the accompanying claims.

I claim:

1. A heat exchanger for receiving fluids from a plurality of mechanisms that each impart heat energy to one of the fluids, comprising a series of tubes arranged side-by-side in an arcuate pattern, each of said tubes being generally sector shaped in cross section and having discrete inner and outer sections each providing a separate fluid flow path, tank means for receiving fluid from at least one of said mechanisms, said tank means being connected to the outer sections of said tubes for circulating fluid therethrough, fluid conductor means for operatively connecting the inner sections of said tubes to a second of said mechanisms, and web means interconnecting said inner and outer sections of each tube for insulating said fluid flow paths from one another and reducing the conduction of heat energy between fluids flowing in the flow paths of said inner and outer sections.

2. A heat exchanger according to claim 1 wherein each of said inner and outer sections of each of said tubes is generally sector shaped in cross section, said inner section having a rounded nose defining the radially inner edge of said tube and a pair of side walls diverging from said nose to a back wall, said outer section having an interior end wall and a pair of side walls diverging therefrom to an end wall defining the radially outer edge of said tube, said interior end wall being spaced radially outwardly from said back wall by said web means.

3. A heat exchanger according to claim 2 wherein said web means is connected to said back wall and has side walls formed by radially inward extensions of the side walls of said outer section.

4. A heat exchanger according to claim 3 wherein the side walls of said web means have air flow openings therethrough.

5. A heat exchanger according to claim 1 further comprising a bladed centrifugal fan having a rotational axis mounted radially inwardly of said series of tubes, the space between the sides of the outer sections of adjacent tubes being greater than the space between the sides of the inner sections thereof to form air flow passages therebetween which increase in flow capacity in the radially outward direction from the rotational axis of said fan.

6. A heat exchanger according to claim 5 wherein each of said series of tubes is inclined with respect to a radial line from the rotational axis of said fan to substantially align said air flow passages with the direction of the air flow from said fan to provide a pressure drop in the air flow through said air flow passages.

7. A heat exchanger according to claim 6 wherein said bladed fan has blades inclined to discharge air with a directional velocity substantially aligned with said air flow passages.

8. A heat exchanger according to claim 5 wherein said series of tubes is arranged so that the sides of the outer and inner sections of adjacent tubes are substantially parallel, outer corrugated air centers mounted between and contacting the adjacent sides of said outer sections, and inner corrugated air centers mounted between and contacting the adjacent sides of said inner sections.

9. A heat exchanger according to claim 1 wherein said plurality of mechanisms comprise an internal combustion engine having a coolant system and at least one accessory driven by said engine, said tank means being connected to said coolant system for circulating engine coolant through the outer sections of said tubes, and said fluid conductor means connecting the inner sections of a plurality of said tubes to said accessory.

10. A heat exchanger according to claim 9 wherein said engine has a plurality of accessories each imparting heat energy to a fluid, said inner sections of said tubes are connected in a plurality of groups corresponding to the number of said plurality of accessories, said fluid conductor means connecting each of said groups to a certain one of said accessories.

11. A heat exchanger according to claim 10 further comprising cooler means mounted in said tank means in heat transferring relating with engine coolant therein, and means for connecting said cooler means to one of said accessories.

12. A circular heat exchanger including bladed fan means for effecting the flow of cooling air therethrough, said heat exchanger having tank means for receiving a fluid from a mechanism that imparts heat energy to said fluid and for returning the fluid back to the mechanism, a plurality of elongated tubes operatively connected to said tank means for circulating said fluid supplied to said tank means, each of said plurality of tubes being generally sector shaped in cross section and having discrete inner and outer sections each providing a separate fluid flow passage therethrough, and web means interconnecting said inner and outer sections to each other for insulating said flow passages from one another and reducing the conduction of heat energy between fluids flowing in the passages of the discrete inner and outer sections.

13. The heat exchanger of claim 12, wherein said web means interconnecting said inner and outer sections has side walls and wherein said side walls have openings therein through which the cooling air from the fan means can flow.

* * * * *

UNITED STATES PATENT AND TRADEMARK OFFICE

CERTIFICATE OF CORRECTION

PATENT NO. : 5,172,752

DATED : December 22, 1992

INVENTOR(S) : Edward E. Goetz, Jr.

It is certified that error appears in the above-identified patent and that said Letters Patent is hereby corrected as shown below:

Column 2, line 33, "handling" should read --producing--

Column 4, line 1, "tubes" should read --tube--

Column 4, line 18, "tube passes" should read --tubes--

Column 5, line 34, "features" should read --feature--

Column 5, line 44, "continuation" should read --continuations--

Column 5, line 52, delete "radiator" after --cooling--

Column 7, line 2, "connecting" should read --connect--

Column 7, line 33, ";72" should read --172--

Column 8, line 23, "the" should read --an--

Signed and Sealed this

Nineteenth Day of October, 1993

Bruce Lehman

*Attest:*

BRUCE LEHMAN

*Attesting Officer*

*Commissioner of Patents and Trademarks*